US005829867A

United States Patent [19]

Baczek et al.

[11] Patent Number: 5,829,867

[45] Date of Patent: Nov. 3, 1998

[54] CONNECTOR ASSEMBLY FOR USE WITH HALOGEN LAMPS

[75] Inventors: Stanley K. Baczek, Muncy, Pa.; Joel Slavis, New York, N.Y.

[73] Assignee: Light Wave Concepts, Inc., Milford, Pa.

[21] Appl. No.: 638,240

[22] Filed: Apr. 26, 1996

[51] Int. Cl.[6] ..... F21V 29/00; F21V 29/34

[52] U.S. Cl. ..... 362/264; 362/249; 362/294; 362/391; 362/226; 313/310.01; 313/48; 315/76; 439/485; 439/119; 439/346

[58] Field of Search ..... 439/346, 110, 439/119, 120, 121, 485, 487, 477; 362/249, 294, 217, 220, 221, 226, 293, 264, 391; 315/50, 112, 76, 326; 313/45, 318.12, 579, 580, 310.01, 310.08, 46

[56] References Cited

U.S. PATENT DOCUMENTS

| | | | |
|---|---|---|---|
| 4,258,293 | 3/1981 | Judge et al. | 315/203 |
| 4,507,719 | 3/1985 | Quiogue | 362/404 |
| 4,569,568 | 2/1986 | Agabekov . | |
| 4,731,711 | 3/1988 | Engel | 362/147 |
| 4,780,799 | 10/1988 | Groh | 362/294 |
| 4,841,422 | 6/1989 | Groh | 362/294 |
| 4,890,200 | 12/1989 | Mandy | 362/20 |
| 4,927,389 | 5/1990 | Willnat et al. | 439/682 |
| 5,003,432 | 3/1991 | Mandy | 362/20 |
| 5,077,645 | 12/1991 | Habinak | 362/226 |
| 5,145,247 | 9/1992 | Mandy | 362/148 |
| 5,315,490 | 5/1994 | Bastable | 362/32 |
| 5,376,025 | 12/1994 | Willnat et al. | 439/817 |

*Primary Examiner*—Arnold Kinkead
*Attorney, Agent, or Firm*—Duane, Morris & Heckscher

[57] ABSTRACT

Polymeric connectors suitable for use in halogen lamp displays are provided. These connectors include various means for improving their reliability and heat dissipation. In specific embodiments, the electrical conductors of the connector assembly are extended beyond a polymeric connector insulator to provide convective air cooling. In other embodiments, high temperature polymers are provided which improve the heat deflection temperature of the polymeric connector insulator. Additionally, better electrical connections are made possible by more closely managed receiving cavities for lamp leads and the like.

18 Claims, 2 Drawing Sheets

CONNECTOR ASSEMBLY FOR USE WITH HALOGEN LAMPS

FIELD OF THE INVENTION

This invention relates to fixtures for use with current consuming devices and in particular, to methods for dissipating heat from halogen lamps so as to avoid failure in current supply assemblies.

BACKGROUND OF THE INVENTION

Tungsten-halogen low voltage lamps are widely used for retail displays and offer several notable advantages over incandescent lighting systems. For instance, the electrical efficiency of halogen lamps is known to be about 10 times greater than incandescent lamps. A 12 volt halogen lamp produces a greater amount of useable white light than the same wattage incandescent lamp and lasts about two or three times longer.

It is also known that the color spectrum of the light produced by a tungsten-halogen lamps provides a more accurate and more aesthetically pleasing view of many products, such as jewelry, due to the temperature of the tungsten filament and the dichromic coating on the lamp reflector, the latter being known to absorb infrared light.

While the advantages of halogen lamps over incandescent lamps are widely known, lighting designers are often limited in their ability to maximize these benefits. This is generally because conventional fixtures are known to fail due to an inability to dissipate the intense heat produced at the rear of the lamp by the high temperature tungsten filament and the reflector-absorbed infrared energy. Some fixtures are especially vulnerable since they are made from low temperature thermoplastic materials which tend to distort, and even melt, when exposed to elevated temperatures.

One of the critical failure points in halogen lighting systems containing plastics is at the connection point with the connector pins of the lamp base. Overheating produced by the halogen lamp has been known to cause melting of polymer connector elements, shorting of electric current, and loosening of the threaded fasteners of the fixture. On occasion, hot halogen lamps have been known to drop from their supporting fixtures onto the heads of unwary shoppers.

One attempt to improve the heat dissipation of halogen lamps is disclosed in U.S. Pat. No. 4,841,422, assigned to Lighting Technology, Inc. Roakoke, Tex. This fixture design includes an externally finned metal body which is quite complex and expensive to produce. Moreover, the bulkiness of its design detracts from the current "minimalistic approach" to aesthetics that many lighting designers require.

SUMMARY OF THE INVENTION

The present invention provides connector assemblies useful for halogen lamps which include a polymeric connector having a pair of electrically conducting connecting members separated by an insulator. The connecting members include attachment means for connecting to the leads of a current consuming device and to the conductors of a power source. In one embodiment of the invention, the electrically conducting connecting members extend out from a first end portion of the polymeric connector to provide heat dissipation to the halogen lamp.

The connector assemblies of this invention provide a significant improvement over prior art fixtures without tremendously adding to the cost or detracting from the aesthetic appearance. These fixtures take advantage of improvements to design and materials to dissipate heat quickly without damaging the fixture. This invention also provides for improved electrical connections with the leads of halogen lamps, for example, so as to minimize false or loose contacts and open circuits.

In further improvements provided by the numerous embodiments of this invention, specially designed "T" connectors are provided which use high temperature polymers having heat deflection temperatures of at least about 120° C. in order to raise the thermal stability of the assembly. Insertion molding techniques are also employed to anchor light bar connects or other electrical contacts in the assembly to the polymer connector to reduce motion and loosening.

BRIEF DESCRIPTION OF THE DRAWINGS

The accompanying drawings illustrate preferred embodiments of the invention according to the practical application of the principles thereof, and in which.

DETAILED DESCRIPTION OF THE INVENTION

Connector assemblies useful in retaining and providing power to halogen lamps are provided by this invention. The assemblies are easy to use and provide greater reliability by minimizing movement between conductors and leads and by providing better heat dissipation for current consuming devices by permitting air convection cooling. As used herein the "upper portion" and "lower portion" of the T-shaped polymeric connectors of this invention are arbitrary distinctions based upon the upper and lower portions of the letter T as it is used in the English language, even though the polymeric connectors of this invention can be employed in any direction. The term "current consuming device" refers to any electrical device whether it is a lighting fixture, fan or display item, whether it operates on direct or alternating current, or whether it is permanently fixed to a source of electrical power or adapted to be removed.

Figure 1:
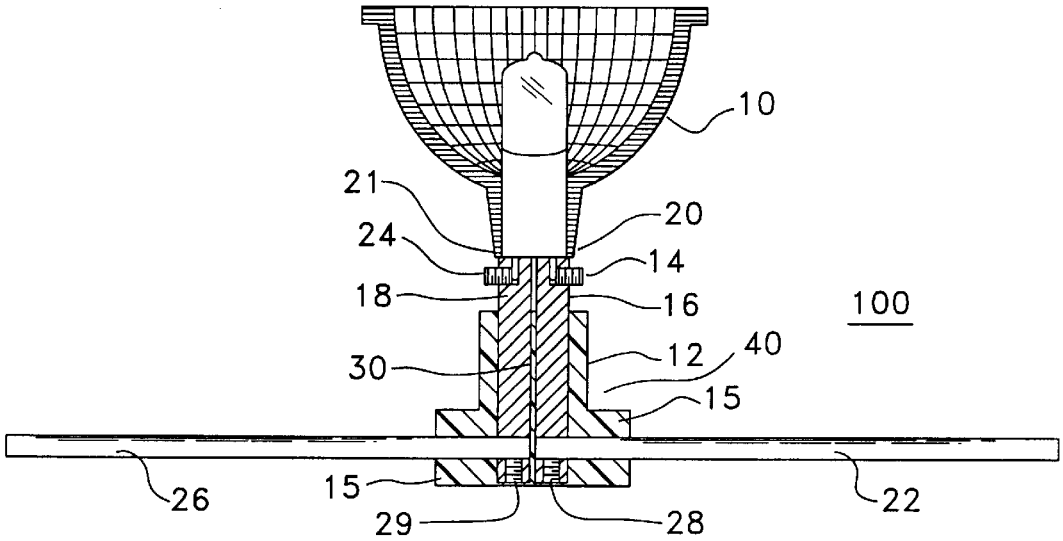
FIG. 1 is a front plan, partial cross-sectional view of a preferred halogen light connector assembly of this invention.
Figure 2:
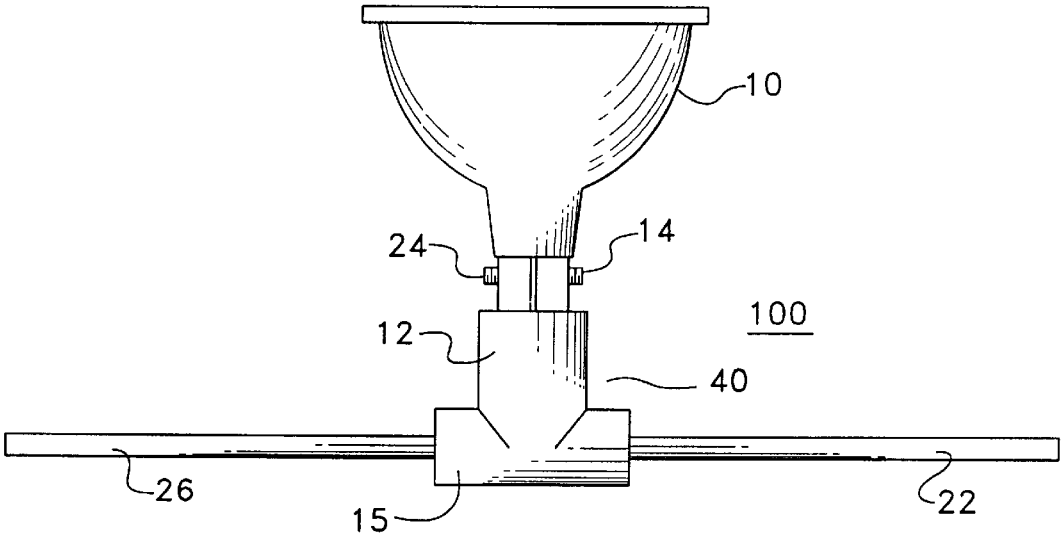
FIG. 2 is a front plan view of the halogen light connector assembly of FIG. 1.

With reference to the figures, and particularly to FIGS. 1 and 2 thereof, there is shown a preferred halogen light connector assembly embodiment 1000 of this invention. The connector assembly 100 includes a polymeric connector 40, and a halogen lamp 10 having a pair of lamp leads 20 and 21 extending from the rear of the lamp 10. Unlike prior art connector assemblies in which the conductors are loosely encapsulated in a plastic shell, this embodiment provides a pair of light bar connects 16 and 18 which are affixed to and extend from the lower portion 12 of the T-shaped polymeric connector 40 a set distance so as to permit heat to dissipate from the halogen lamp 10 and light bar connects 16 and 18. Preferably, the light bar connects 16 and 18 should extend about 0.125"–1", and more preferably about 0.25" from the edge of the lower portion of the polymeric connector 40.

This greatly reduces the resulting temperature between the light bar connects 16 and 18 and the polymeric connector 40. This feature, in combination with others which will be described herein, helps to eliminate any melting of the polymeric connector 40 and avoids what would otherwise be a failure of the electrical circuit.

At the upper portion 15 of the polymeric connector 40 of this embodiment, are disposed a pair of light bars 22 and 26 which distribute a low voltage, direct current to the light bar connects 16 and 18. The light bars 26 and 22 and the light bar connects 16 and 18 are separated by a thin insulator 30, which is preferably a portion of the polymeric connector 40. The conducting elements of the connector assembly 100 of this embodiment, are preferably joined together with threaded fasteners 24, 14, 29 and 28. The threaded fasteners can be equipped with allen or hexagonal-cavity heads so as to permit discrete placement of the head of fasteners when used.

Figure 3A:
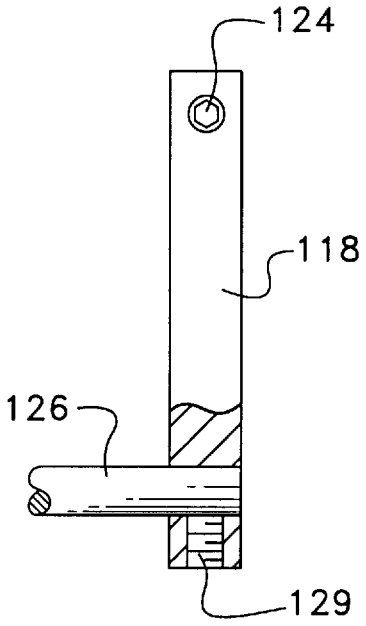
FIG. 3A (PRIOR ART)
FIG. 3A is a front plan view of a prior art light bar connect.
Figure 3B:
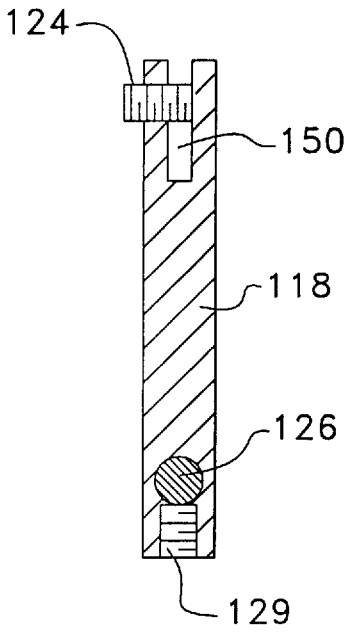
FIG. 3B (PRIOR ART)
FIG. 3B is a side plan, cross-sectional view of the light bar connect of FIG. 3A.
Figure 4A:
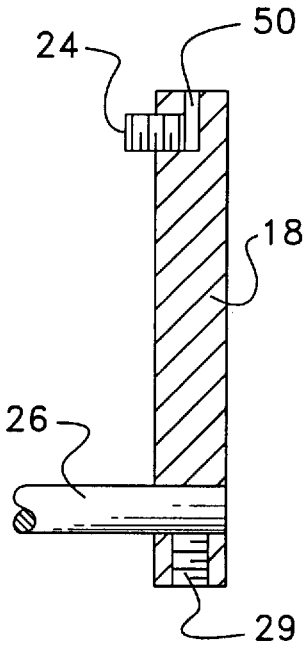
FIG. 4A is a front plan, cross-sectional view of a preferred light bar connect of this invention.
Figure 4B:
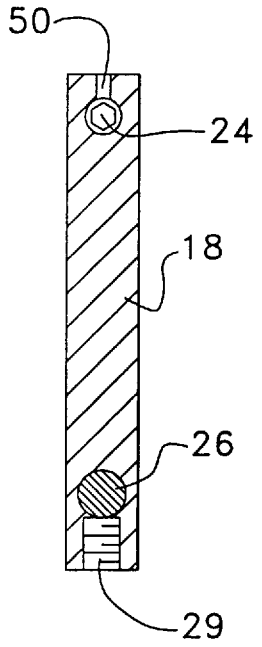
FIG. 4B is a side plan, cross-sectional view of the light bar connect of FIG. 4A.

A more detailed view of the fasteners of this invention is reflected in FIGS. 3A and 3B, representing the prior art, and FIGS. 4A and 4B, representing the light bar connects and threaded fasteners of connector assembly 100. The prior art represented in FIGS. 3A and 3B has been awkward to use since the lead cavity 150 is a slot which is much larger than the lamp leads 20 and 21. If one of the lamp leads 20 and 21 is not properly centered with the threaded fastener 124 it may shift in the lead cavity 150 and not provide good electrical contact. Insecurely fastened lamp leads may also become loose and permit the lamp to fall, which is obviously dangerous to shoppers.

FIG. 4B illustrates that the lead cavity of the connector assembly 100 is much smaller than prior art cavities and more closely approximates the cross section of the lamp leads 20 and 21. More specifically, the cross section of the lead cavity 50 should be no greater than about 200% of the cross section of the lamp lead 20 or 21, and more preferably, exhibits a round cross section similar to that of the lamp leads 20 and 21. This rather snug fit permits the halogen lamp 10 to be inserted into lead cavity 50 in an aligned fashion so that the threaded fasteners 14 and 24 can be compressed against the lamp leads 20 and 21 with little risk of misalignment. Additionally, the threaded fasteners 24 and 14 and their respective threaded openings in the light bar connects 16 and 18 can be placed in the extended portion of the light bar connects 16 and 18 so as to become part of the heat dissipation surface area of the connector assembly 100. In prior art connector assemblies, such fasteners are often located through apertures cut into the polymeric connector. Prior art light bar connects 118 are also known to be completely encapsulated in polymeric material.

At the opposite end of the light bar connects 118 and 18 are located threaded fasteners 129 and 29 which bind and retain light bars 26 and 126. The operation of these threaded fasteners 29 and 129 are substantially similar. One improvement provided by this invention, however, is to encapsulate one end of the light bar connects 16 and 18 into the polymeric material of the polymeric connector 40 during a molding process. This permanently anchors the light bar connects 16 and 18 to the molded polymeric connector, so as to minimize wobbling and movement of the light bar connects in the polymeric connector 40. This improves the ability to fasten lamp leads 20 and 21 and light bars 22 and 26 and improves the reliability of the frictional attachment fasteners joining these connectors.

The preferred materials of this invention will now be reviewed. The polymeric connector 40 of this invention should be made of a high temperature polymer having a heat deflection temperature high enough so as to not melt during the use of typical current consuming devices, such as halogen lamps of about 50–75 watts in capacity. Such polymers should have a heat deflection temperature of at least about 120° C., and preferably at least about 140°–160° C., (which roughly corresponds to the heat dissipated by 50–75 watt halogen lamps). Typically, PMMA has been used for such applications because it is easily molded into various shapes and can be produced in clear polymer varieties. The low heat deflection temperature of PMMA is a disadvantage to lighting designers for the reasons previously expressed. Accordingly, this invention prefers to use higher melting polymers, such as polycarbonate. One variety which is of particular importance is LEXAN polycarbonate from General Electric which has a heat deflection temperature as high as 140° C. Other useful thermoplastics include certain formulations of ABS, fluorocarbons, nylons, polyaryl ether, polyallomer, polyaryl sulphone, polyamide, polyphenylene sulphide, polypropylene, polyphenylene oxide, polysulphone, polyether sulphone and polyetheretherketone and thermosetting plastics, such as polyesters or epoxies. Graphite and glass fiber additions up to 30 wt. % can also help to improve high temperature performance, and liquid-crystal polymers based upon aromatic polyesters are known to have good mechanical properties at temperatures above 300° C. which would make them ideal for this invention if cost concerns are not an issue. Formulations which provide translucent or clear plastics are the most preferred.

The light bar connects of this invention 16 and 18 are preferably about 0.19×0.25" in cross section by about 1.25" long and can be constructed of nickel-plated brass or steel. The cross section of the lead cavity 50 is preferably round and has a diameter of about 0.077–0.082" so as to comfortably receive lamp leads of a slightly smaller dimension.

During manufacturing, the light bar connects 16 and 18 and polymeric connector 40 can be formed together in a single mold using insertion molding techniques. In these techniques, the light bar connects 16 and 18 are placed into machined slots in the mold so that molten polymer forms around them and helps to retain them in position in the polymeric connector 40. This is a low cost manufacturing process that can greatly improve the reliability and installation of the connector assemblies of this invention.

From the foregoing, it can be realized that this invention provides improved connector assemblies especially designed for halogen lamp assemblies. Such assemblies can be used to provide lighted displays for retail, office or home use. The polymeric connectors of this invention provide heat dissipation by exposing the metal surfaces of the light bar connect to convective air currents. This can be done inexpensively by merely adding about 0.25" to the ends of the light bar connect conductors so that they extend from the polymeric connector. High temperature polymers and more snugly designed receiving cavities for lamp leads also represent marked improvement over prior art designs. Although various embodiments have been illustrated, this was for the purpose of describing, but not limiting the invention. Various modifications, which will become apparent to one skilled in the art, are within the scope of this invention described in the attached claims.

We claim:

1. A halogen lamp connector assembly, comprising:

a polymeric connector having a pair of electrically conducting connecting members separated by an insulator, said connecting members comprising means for attaching said connecting members to a pair of leads of said halogen lamp at a first portion of said polymeric connector and to a pair of power source conductors at a second portion of said polymeric connector; said connecting members extending out from said first end portion of said polymeric connector to provide heat dissipation for said halogen lamp.

2. The connector assembly of claim 1 wherein said insulator comprises a portion of said polymeric connector.

3. The connector assembly of claim 1 wherein said electrically conducting connecting members comprise substantially parallel bar connectors.

4. The connector assembly of claim 1 wherein said polymeric connector comprises a T-shaped molded polymeric element.

5. The connector assembly of claim 4 wherein said electrically conducting connecting members are disposed longitudinally through a lower portion of said T-shaped molded polymeric element.

6. The connector assembly of claim 5 wherein said pair of power source conductors are disposed partially through an upper portion of said T-shaped molded polymeric element.

7. The connector assembly of claim 6 wherein said means for attaching said connecting members to a pair of leads of said halogen lamp comprises a pair of longitudinal cavities opening at a transverse end of each of said connecting members, said cavities having a cross-section which is no greater than about 200% of the cross-section of one of said leads.

8. A halogen lamp connector assembly comprising:

a T-shaped polymeric connector having a pair of electrically conducting connecting members separated by an insulator, said connecting members comprising means for attaching said connecting members to a pair of leads of said halogen lamp at a first portion of said polymeric connector and to a pair of power source conductors at a second portion of said polymeric connector said polymeric connector comprising of high temperature polymer having a heat deflection temperature of at least 120° C. under a flexural load; each of said connecting members comprising a cavity opening proximate to said first portion of said polymeric connector for receiving one of said leads; each of said cavity openings having a cross-section which is no greater than about 200% of the cross-section of one of said leads.

9. The connector assembly of claim 8 wherein said electrically conducting connecting members are separated by an insulating portion of said polymeric connector.

10. The connector assembly of claim 9 wherein said cavity openings are circular in cross-section.

11. A halogen lamp connector assembly comprising:

a polymeric connector having a pair of electrically conducting connecting members separated by an insulator, said connecting members comprising means for attaching said connecting members to a pair of leads of said halogen lamp at a first portion of said polymeric connector and to a pair of power source conductors at a second portion of said polymeric connector; wherein said means for attaching said connecting members to a pair of power source conductors comprises a pair of transverse holes in said connecting members for receiving a pair of power source conductors and threaded fasteners mounted longitudinally into each of said connecting members so as to frictionally bind said power source conductors in said transverse holes said polymeric connector comprising a high temperature polymer having a heat deflection temperature of at least about 120° C. under a flexural load.

12. The connector assembly of claim 11 wherein said high-temperature polymer comprises a polycarbonate.

13. The connector assembly of claim 11 wherein said polymeric connector is transparent or translucent.

14. The connector assembly of claim 11 wherein said polymeric connector is molded from molten plastic.

15. A connector assembly, comprising:

a T-shaped polymeric connector substantially enclosing a pair of electrically conducting bar connectors;

attachment means for attaching said conducting bar connectors to a pair of leads of a current consuming device and to a pair of power source conductors; each of said bar connectors having end portions which extend out from said polymeric connector to dissipate heat from said current consuming device; said polymeric connector having a heat deflection temperature of at least about 120° C. under a flexural load.

16. The connector assembly of claim 15 wherein said current consuming device comprises a halogen lamp.

17. The connector assembly of claim 15 wherein said end portion of each of said bar connectors extends out from said polymeric connector at least about 0.125".

18. A method of providing a lighted display, comprising:

providing a halogen lamp connector assembly comprising a polymeric connector having a pair of electrically conducting connecting members separated by an insulator, said connecting members comprising means for attaching to a pair of leads of a halogen lamp at a first end portion of said polymeric connector and to a pair of power source conductors at a second end portion of said polymeric connector; said connecting members extending from said first end portion of said polymeric connector to provide heat dissipation for said halogen lamp;

connecting said electrically conducting connecting members between a halogen lamp and a source of electrical power;

illuminating said halogen lamp to provide an aesthetic display of light.

* * * * *